US007774205B2

(12) United States Patent
Koishida et al.

(10) Patent No.: US 7,774,205 B2
(45) Date of Patent: Aug. 10, 2010

(54) CODING OF SPARSE DIGITAL MEDIA SPECTRAL DATA

(75) Inventors: Kazuhito Koishida, Redmond, WA (US); Sanjeev Mehrotra, Kirkland, WA (US); Wei-Ge Chen, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 693 days.

(21) Appl. No.: 11/764,108

(22) Filed: Jun. 15, 2007

(65) Prior Publication Data

US 2008/0312758 A1 Dec. 18, 2008

(51) Int. Cl.
*G10L 21/04* (2006.01)

(52) U.S. Cl. ..... 704/503; 704/230

(58) Field of Classification Search ..... 704/222, 704/230, 503

See application file for complete search history.

(56) References Cited

U.S. PATENT DOCUMENTS

| | | | |
|---|---|---|---|
| 4,420,771 | A | 12/1983 | Pirsch |
| 4,698,672 | A | 10/1987 | Chen |
| 4,792,981 | A | 12/1988 | Cahill et al. |
| 4,813,056 | A | 3/1989 | Fedele |
| 4,901,075 | A | 2/1990 | Vogel |
| 4,968,135 | A | 11/1990 | Wallace et al. |
| 5,040,217 | A | 8/1991 | Brandenburg et al. |
| 5,043,919 | A | 8/1991 | Callaway et al. |
| 5,045,938 | A | 9/1991 | Sugiyama |
| 5,089,818 | A | 2/1992 | Mahieux et al. |
| 5,128,758 | A | 7/1992 | Azadegan |
| 5,146,324 | A | 9/1992 | Miller et al. |
| 5,179,442 | A | 1/1993 | Azadegan |
| 5,227,788 | A | 7/1993 | Johnston |
| 5,227,878 | A | 7/1993 | Puri et al. |
| 5,266,941 | A | 11/1993 | Akeley et al. |
| 5,381,144 | A | 1/1995 | Wilson et al. |
| 5,394,170 | A | 2/1995 | Akeley et al. |

(Continued)

FOREIGN PATENT DOCUMENTS

| | | |
|---|---|---|
| EP | 0 540 350 | 5/1993 |

(Continued)

OTHER PUBLICATIONS

Lee, "Wavelet Filter Banks in Perceptual Audio Coding," Thesis presented to the University of Waterloo, 2003, 144 pages.

(Continued)

*Primary Examiner*—Abul Azad
(74) *Attorney, Agent, or Firm*—Klarquist Sparkman, LLP

(57) ABSTRACT

An audio encoder/decoder provides efficient compression of spectral transform coefficient data characterized by sparse spectral peaks. The audio encoder/decoder applies a temporal prediction of the frequency position of spectral peaks. The spectral peaks in the transform coefficients that are predicted from those in a preceding transform coding block are encoded as a shift in frequency position from the previous transform coding block and two non-zero coefficient levels. The prediction may avoid coding very large zero-level transform coefficient runs as compared to conventional run length coding. For spectral peaks not predicted from those in a preceding transform coding block, the spectral peaks are encoded as a value trio of a length of a run of zero-level spectral transform coefficients, and two non-zero coefficient levels.

17 Claims, 7 Drawing Sheets

U.S. PATENT DOCUMENTS 5,400,075 A 3/1995 Savatier
5,457,495 A 10/1995 Hartung
5,461,421 A 10/1995 Moon
5,467,134 A 11/1995 Laney
5,481,553 A 1/1996 Suzuki
5,493,407 A 2/1996 Takahara
5,504,591 A 4/1996 Dujari
5,533,140 A 7/1996 Sirat et al.
5,544,286 A 8/1996 Laney
5,559,557 A 9/1996 Kato et al.
5,568,167 A 10/1996 Galbi et al.
5,574,449 A 11/1996 Golin
5,579,430 A 11/1996 Grill et al.
5,640,420 A 6/1997 Jung
5,654,706 A 8/1997 Jeong et al.
5,661,755 A 8/1997 Van de Kerkhof
5,668,547 A 9/1997 Lee
5,706,001 A 1/1998 Sohn
5,717,821 A 2/1998 Tsutsui
5,748,789 A 5/1998 Lee et al.
5,819,215 A 10/1998 Dobson et al.
5,825,830 A 10/1998 Kopf
5,828,426 A 10/1998 Yu
5,835,144 A 11/1998 Matsumura
5,883,633 A 3/1999 Gill et al.
5,884,269 A 3/1999 Cellier et al.
5,946,043 A 8/1999 Lee et al.
5,956,686 A 9/1999 Takashima et al.
5,969,650 A 10/1999 Wilson et al.
5,974,184 A 10/1999 Eifrig et al.
5,982,437 A 11/1999 Okazaki
5,990,960 A 11/1999 Murakami
5,991,451 A 11/1999 Keith et al.
5,995,670 A 11/1999 Zabinsky
6,002,439 A 12/1999 Murakami
6,049,630 A 4/2000 Wang et al.
6,054,943 A 4/2000 Lawrence
6,078,691 A 6/2000 Luttmer
6,097,759 A 8/2000 Murakami
6,100,825 A 8/2000 Sedluk
6,111,914 A 8/2000 Bist
6,148,109 A 11/2000 Boon
6,154,572 A 11/2000 Chaddha
6,205,256 B1 3/2001 Chaddha
6,215,910 B1 4/2001 Chaddha
6,223,162 B1 4/2001 Chen
6,226,407 B1 5/2001 Zabih et al.
6,233,017 B1 5/2001 Chaddha
6,253,165 B1 6/2001 Malvar
6,256,064 B1 7/2001 Chujoh et al.
6,259,810 B1 7/2001 Gill et al.
6,272,175 B1 8/2001 Sriram et al.
6,292,588 B1 9/2001 Shen
6,300,888 B1 10/2001 Chen
6,304,928 B1 10/2001 Mairs et al.
6,337,881 B1 1/2002 Chaddha
6,341,165 B1 1/2002 Gbur
6,345,123 B1 2/2002 Boon
6,349,152 B1 2/2002 Chaddha
6,360,019 B1 3/2002 Chaddha
6,377,916 B1 * 4/2002 Hardwick ..... 704/208
6,377,930 B1 4/2002 Chen
6,392,705 B1 5/2002 Chaddha
6,404,931 B1 6/2002 Chen
6,420,980 B1 7/2002 Ejima
6,421,738 B1 7/2002 Ratan et al.
6,441,755 B1 8/2002 Dietz et al.
6,477,280 B1 11/2002 Malvar
6,493,385 B1 12/2002 Sekiguchi et al.
6,499,010 B1 12/2002 Faller
6,542,631 B1 4/2003 Ishikawa
6,542,863 B1 4/2003 Surucu
6,573,915 B1 6/2003 Sivan et al.
6,600,872 B1 7/2003 Yamamoto
6,611,798 B2 8/2003 Bruhn et al.
6,646,578 B1 11/2003 Au
6,678,419 B1 1/2004 Malvar
6,680,972 B1 1/2004 Liljeryd et al.
6,690,307 B2 2/2004 Karczewicz
6,704,705 B1 3/2004 Kabal et al.
6,721,700 B1 4/2004 Yin
6,728,317 B1 4/2004 Demos
6,766,293 B1 7/2004 Herre et al.
6,771,777 B1 8/2004 Gbur
6,795,584 B2 9/2004 Karczewicz et al.
6,825,847 B1 11/2004 Molnar et al.
6,947,886 B2 9/2005 Rose et al.
6,954,157 B2 10/2005 Kadono et al.
6,975,254 B1 12/2005 Sperschneider et al.
7,016,547 B1 3/2006 Smirnov
7,447,631 B2 * 11/2008 Truman et al. ..... 704/230
2002/0076115 A1 6/2002 Leeder et al.
2003/0138150 A1 7/2003 Srinivasan
2003/0147561 A1 8/2003 Faibish et al.
2003/0156648 A1 8/2003 Holcomb et al.
2003/0202601 A1 10/2003 Bjontegaard et al.
2003/0225576 A1 12/2003 Li et al.
2004/0044534 A1 3/2004 Chen et al.
2004/0049379 A1 3/2004 Thumpudi et al.
2004/0136457 A1 7/2004 Funnell et al.
2005/0015249 A1 1/2005 Mehrotra et al.
2005/0041874 A1 2/2005 Langelaar et al.
2005/0052294 A1 3/2005 Liang et al.
2007/0162277 A1 * 7/2007 Kurniawati et al. ..... 704/200.1
2007/0172071 A1 7/2007 Mehrotra et al.
2007/0174062 A1 7/2007 Mehrotra et al.

FOREIGN PATENT DOCUMENTS

EP 0 910 927 1/1998
EP 0 966 793 9/1998
EP 0 931 386 1/1999
EP 1 142 130 4/2003
EP 1 142 129 6/2004
GB 2 372 918 9/2002
JP 5-292481 11/1993
JP 6-021830 1/1994
JP 6-217110 8/1994
JP 7-274171 10/1995
JP 2002 204170 7/2002
WO WO 98/00924 1/1998

OTHER PUBLICATIONS

Novak et al., "Spectral Band Replication and aacPlus Coding—An Overview," © 2003 TLC Corp., 2 pages.
Painter et al., "A Review of Algorithms for Perceptual Coding of Digital Audio Signals," *13th International Conference on Digital Signal Processing Proceedings*, 1997, 30 pages.
U.S. Appl. No. 60/341,674, filed Dec. 2001, Lee et al.
U.S. Appl. No. 60/488,710, filed Jul. 2003, Srinivasan et al.
Bosi et al., "ISO/IEC MPEG-2 Advance Audio Coding," J. Audio Eng. Soc., vol. 45, No. 10, pp. 789-812 (1997).
Brandenburg, "ASPEC Coding," *AES 10th International Conference*, pp. 81-90 (1991).
Chung et al., "A Novel Memory-efficient Huffman Decoding Algorithm and its Implementation," Signal Processing 62, pp. 207-213 (1997).
Costa et al., "Efficient Run-Length Encoding of Binary Sources with Unknown Statistics", Technical Report No. MSR-TR-2003-95, pp. 1-10, Microsoft Research, Microsoft Corporation (Dec. 2003).
Cui et al., "A novel VLC based on second-run-level coding and dynamic truncation," *Proc. SPIE*, vol. 6077, pp. 607726-1 to 607726-9 (2006).

De Agostino et al., "Parallel Algorithms for Optimal Compression using Dictionaries with the Prefix Property," *Proc. Data Compression Conference '92, IEEE Computer Society Press*, pp. 52-62 (1992).

Gailly, "comp.compression Frequently Asked Questions (part ⅓)," 64 pp., document marked Sep. 5, 1999 [Downloaded from the World Wide Web on Sep. 5, 2007].

Gibson et al., *Digital Compression for Multimedia*, "Chapter 2: Lossless Source Coding," Morgan Kaufmann Publishers, Inc., San Francisco, pp. 17-61 (1998).

Gill et al., "Creating High-Quality Content with Microsoft Windows Media Encoder 7," 4 pp. (2000) [ Downloaded from the World Wide Web on May 1, 2002].

Hui et al., "Matsushita Algorithm for Coding of Moving Picture Information," ISO/IEC-JTC1/SC29/WG11, MPEG91/217, 76 pp. (Nov. 1991).

Ishii et al., "Parallel Variable Length Decoding with Inverse Quantization for Software MPEG-2 Decoders," IEEE Signal Processing Systems, pp. 500-509 (1997).

ISO/IEC, "ISO/IEC 11172-2, Information Technology—Coding of Moving Pictures and Associated Audio for Digital Storage Media at up to About 1.5 Mbit/s—Part 2: Video," 112 pp. (1993).

"ISO/IEC 11172-3, Information Technology—Coding of Moving Pictures and Associated Audio for Digital Storage Media at Up to Ab out 1.5 Mbit/s—Part 3: Audio," 154 pp. (1993).

"ISO/IEC 13818-7, Information Technology—Generic Coding of Moving Pictures and Associated Audio Information—Part 7: Advanced Audio Coding (AAC)," 174 pp. (1997).

ISO/IEC 14496-2, "Coding of Audio-Visual Object—Part 2: Visual," Third Edition, pp. 1-727, (Jun. 2004).

ISO/IEC, "JTC1/SC29/WG11 N2202, Information Technology—Coding of Audio-Visual Objects: Visual, ISO/IEC 14496-2," 329 pp. (1998).

ITU-T, "ITU-T Recommendation H.261, Video Codec for Audiovisual Services at *p* x 64 kbits," 25 pp. (1993).

ITU-T, "ITU-T Recommendation H.262, Information Technology—Generic Coding of Moving Pictures and Associated Audio Information: Video," 205 pp. (1995).

ITU-T, "ITU-T Recommendation H.263, Video coding for low bit rate communication," 162 pp. (1998).

ITU-T Recommendation H.264, "Series H: Audiovisual and Multimedia Systems, Infrastructure of Audiovisual Services—Coding of Moving Video," International Telecommunication Union, pp. 1-262 (May 2003).

ITU-T Recommendation T.800, "Series T: Terminals for Telematic Services," International Telecommunication Union, pp. 1-194 (Aug. 2002).

Jeong et al., "Adaptive Huffman Coding of 2-D DCT Coefficients for Image Sequence Compression," *Signal Processing: Image Communication*, vol. 7, 11 pp. (1995).

Joint Video Team (JVT) of ISO/IEC MPEG & ITU-T VCEG, "Joint Final Committee Draft (JFCD) of Joint Video Specification," JCVT-D157, 207 pp. (Aug. 2002).

Joint Video Team (JVT) of ISO/IEC MPEG & ITU-T VCEG, "Draft ITU-T Recommendation and Final Draft International Standard of Joint Video Specification (ITU-T Rec. H.264, ISO/IEC 14496-10 AVC)," 253 pp. (May 2003).

Li et al., "Optimal Linear Interpolation Coding for Server-Based Computing," *Proc. IEEE Int'l Conf. on Communications*, 5 pp. (Apr.-May 2002).

Malvar, "Fast Progressive Image Coding without Wavelets", IEEE Data Compression Conference, Snowbird, Utah, 10 pp. (Mar. 2000).

Microsoft Corporation, "Microsoft Debuts New Windows Media Player 9 Series, Redefining Digital Media on the PC," 4 pp. (Sep. 4, 2002) [Downloaded from the World Wide Web on Jul. 16, 2004].

Mook, "Next-Gen Windows Media Player Leaks to the Web," *BetaNews*, 18 pp. (Jul. 2002) [Downloaded from the World Wide Web on Mar. 16, 2004].

Nelson, *The Data Compression Book*, "Huffman One Better: Arithmetic Coding," Chapter 5, pp. 123-165 (1992).

Printouts of FTP directories from http://ftp3.itu.ch, 8 pp. [Downloaded from the World Wide Web on Sep. 20, 2005].

Reader, "History of MPEG Video Compression—Ver. 4.0," 99 pp., document marked Dec. 16, 2003.

Search Report and Written Opinion of PCT/US06/30308 dated Oct. 23, 2007.

Shamoon et al., "A Rapidly Adaptive Lossless Compression Algorithm for High Fidelity Audio Coding," *IEEE Data Compression Conf.*, pp. 430-439 (Mar. 1994).

Sullivan et al., "The H.264/AVC Advanced Video Coding Standard: Overview and Introduction to the Fidelity Range Extensions," 21 pp. (Aug. 2004).

Tu et al., "Context-Based Entropy Coding of Block Transform Coefficients for Image Compression," *IEEE Transactions on Image Processing*, vol. 11, No. 11, pp. 1271-1283 (Nov. 2002).

Wien et al., "16 Bit Adaptive Block Size Transforms," JVT-C107r1, 54 pp.

Wien, "Variable Block-Size Transforms for Hybrid Video Coding," Dissertation, 182 pp. (Feb. 2004).

* cited by examiner

CODING OF SPARSE DIGITAL MEDIA SPECTRAL DATA

BACKGROUND

Perceptual Transform Coding

The coding of audio utilizes coding techniques that exploit various perceptual models of human hearing. For example, many weaker tones near strong ones are masked so they do not need to be coded. In traditional perceptual audio coding, this is exploited as adaptive quantization of different frequency data. Perceptually important frequency data are allocated more bits and thus finer quantization and vice versa.

For example, transform coding is conventionally known as an efficient scheme for the compression of audio signals. In transform coding, a block of the input audio samples is transformed (e.g., via the Modified Discrete Cosine Transform or MDCT, which is the most widely used), processed, and quantized. The quantization of the transformed coefficients is performed based on the perceptual importance (e.g. masking effects and frequency sensitivity of human hearing), such as via a scalar quantizer.

When a scalar quantizer is used, the importance is mapped to relative weighting, and the quantizer resolution (step size) for each coefficient is derived from its weight and the global resolution. The global resolution can be determined from target quality, bit rate, etc. For a given step size, each coefficient is quantized into a level which is zero or non-zero integer value.

At lower bitrates, there are typically many more zero level coefficients than non-zero level coefficients. They can be coded with great efficiency using run-length coding. In run-length coding, all zero-level coefficients typically are represented by a value pair consisting of a zero run (i.e., length of a run of consecutive zero-level coefficients), and level of the non-zero coefficient following the zero run. The resulting sequence is $R_0,L_0,R_1,L_1 \ldots$, where R is zero run and L is non-zero level.

By exploiting the redundancies between R and L, it is possible to further improve the coding performance. Run-level Huffman coding is a reasonable approach to achieve it, in which R and L are combined into a 2-D array (R,L) and Huffman-coded. Because of memory restrictions, the entries in Huffman tables cannot cover all possible (R,L) combinations, which requires special handling of the outliers. A typical method used for the outliers is to embed an escape code into the Huffman tables, such that the outlier is coded by transmitting the escape code along with the independently quantized R and L.

When transform coding at low bit rates, a large number of the transform coefficients tend to be quantized to zero to achieve a high compression ratio. This could result in there being large missing portions of the spectral data in the compressed bitstream. After decoding and reconstruction of the audio, these missing spectral portions can produce an unnatural and annoying distortion in the audio. Moreover, the distortion in the audio worsens as the missing portions of spectral data become larger. Further, a lack of high frequencies due to quantization makes the decoded audio sound muffled and unpleasant.

Wide-Sense Perceptual Similarity

Perceptual coding also can be taken to a broader sense. For example, some parts of the spectrum can be coded with appropriately shaped noise. When taking this approach, the coded signal may not aim to render an exact or near exact version of the original. Rather the goal is to make it sound similar and pleasant when compared with the original. For example, a wide-sense perceptual similarity technique may code a portion of the spectrum as a scaled version of a code-vector, where the code vector may be chosen from either a fixed predetermined codebook (e.g., a noise codebook), or a codebook taken from a baseband portion of the spectrum (e.g., a baseband codebook).

All these perceptual effects can be used to reduce the bit-rate needed for coding of audio signals. This is because some frequency components do not need to be accurately represented as present in the original signal, but can be either not coded or replaced with something that gives the same perceptual effect as in the original.

In low bit rate coding, a recent trend is to exploit this wide-sense perceptual similarity and use a vector quantization (e.g., as a gain and shape code-vector) to represent the high frequency components with very few bits, e.g. 3 kbps. This can alleviate the distortion and unpleasant muffled effect from missing high frequencies and other large portions of spectral data. The transform coefficients of the "missing spectral portions" are encoded using the vector quantization scheme. It has been shown that this approach enhances the audio quality with a small increase of bit rate.

Nevertheless, due to the bit rate limitation, the quantization is very coarse. While this is efficient and sufficient for the vast majority of the signals, it still causes an unacceptable distortion for high frequency components that are very "tonal." A typical example can be the very high pitched sound from a string instrument. The vector quantizer may distort the tones into a coarse sounding noise.

SUMMARY

The following Detailed Description concerns various audio encoding/decoding techniques and tools that provide an efficient way to compress spectral peak data that may be separated with many zero-level coefficients (i.e., sparse spectral peak data). Because the probability of a zero coefficient is much higher in this situation than the normal case, the traditional Huffman run length coding approach can have poor compression due to frequently invoking the expensive escape codes. Arithmetic coding techniques also may not be an option due to complexity concerns.

One way to alleviate the tonal distortion problem mentioned earlier is to exclude these tonal components from the vector quantizer and code them separately with higher fidelity. The procedure constitutes isolating these components by detecting peaks in the spectrum and quantizing them separately with higher precision and bit rate. Since the spectral peaks are far and apart, the impact on the total bit rate is very small if the peaks are coded efficiently.

An efficient coding scheme for sparse spectral peak data described herein is based on the following observations:

1. Spectral peaks are far and apart;
2. Spectral peaks tend to be coherent over time; and
3. A tone typically results in more than 1 non-zero coefficient in the MDCT domain.

In accordance with one version of the efficient coding scheme for sparse spectral peak data described herein, a temporal prediction of the frequency position of a spectral peak is applied. Strong frequency components (i.e., spectral peaks) created by bells, triangles, etc. stay around over a few successive coding blocks in time. Accordingly, a spectral peak is predictively coded as a shift (S) from its frequency position in a previous coding block. This avoids coding very large zero runs (R) between sparse spectral peaks.

The version of the efficient coding scheme for sparse spectral peak data further jointly quantizes the spectral peak data as a value trio of a zero run, and two non-zero coefficient levels (e.g., $(R,(L_0,L_1))$ ). As per the observation remarked above, the tones corresponding to a spectral peak are generally represented in the MDCT as a few transformed coefficients about the peak. For most phases, two coefficients are dominant. It is therefore expected that quantizing the spectral peak data jointly as the three value combination $(R,(L_0,L_1))$, where $L_0$, $L_1$ are levels of adjacent non-zero coefficients, is more efficient than quantizing the two coefficients as joint value pairs $(R,L_0)$ and $(0,L_1)$.

This Summary is provided to introduce a selection of concepts in a simplified form that is further described below in the Detailed Description. This summary is not intended to identify key features or essential features of the claimed subject matter, nor is it intended to be used as an aid in determining the scope of the claimed subject matter. Additional features and advantages of the invention will be made apparent from the following detailed description of embodiments that proceeds with reference to the accompanying drawings.

DETAILED DESCRIPTION

Various techniques and tools for representing, coding, and decoding audio information are described. These techniques and tools facilitate the creation, distribution, and playback of high quality audio content, even at very low bitrates.

The various techniques and tools described herein may be used independently. Some of the techniques and tools may be used in combination (e.g., in different phases of a combined encoding and/or decoding process).

Various techniques are described below with reference to flowcharts of processing acts. The various processing acts shown in the flowcharts may be consolidated into fewer acts or separated into more acts. For the sake of simplicity, the relation of acts shown in a particular flowchart to acts described elsewhere is often not shown. In many cases, the acts in a flowchart can be reordered.

Much of the detailed description addresses representing, coding, and decoding audio information. Many of the techniques and tools described herein for representing, coding, and decoding audio information can also be applied to video information, still image information, or other media information sent in single or multiple channels.

I. Computing Environment

Figure 1:
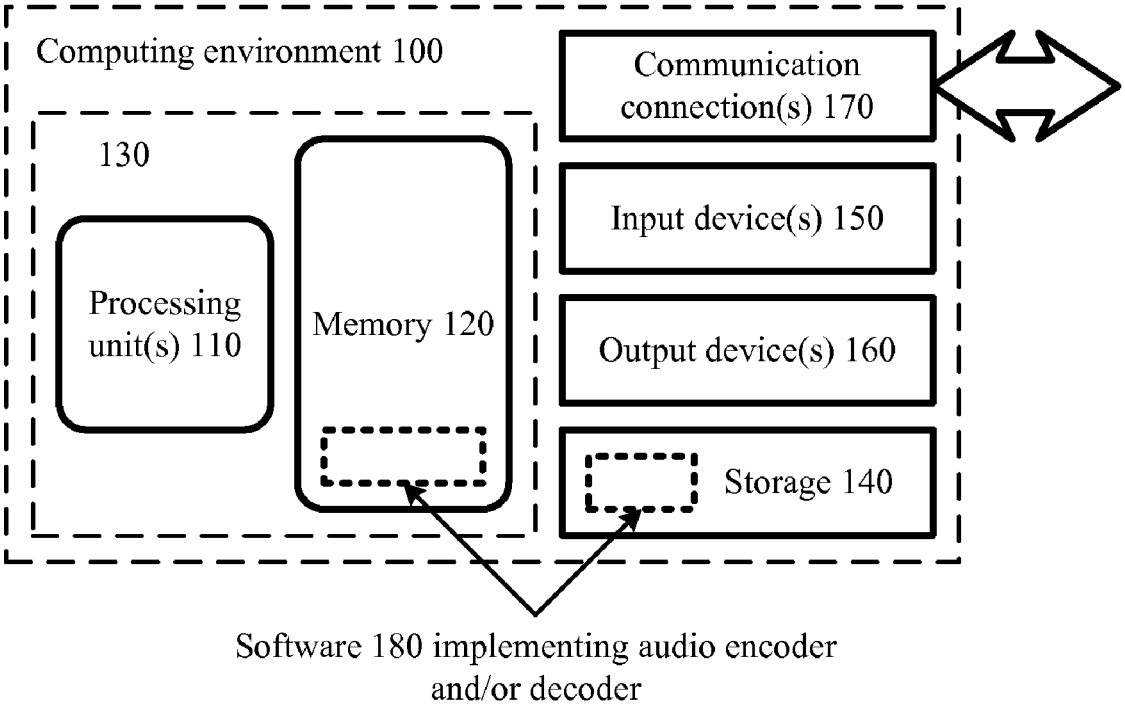
FIG. 1 is a block diagram of a generalized operating environment in conjunction with which various described embodiments may be implemented.

FIG. 1 illustrates a generalized example of a suitable computing environment 100 in which described embodiments may be implemented. The computing environment 100 is not intended to suggest any limitation as to scope of use or functionality, as described embodiments may be implemented in diverse general-purpose or special-purpose computing environments.

With reference to FIG. 1, the computing environment 100 includes at least one processing unit 110 and memory 120. In FIG. 1, this most basic configuration 130 is included within a dashed line. The processing unit 110 executes computer-executable instructions and may be a real or a virtual processor. In a multi-processing system, multiple processing units execute computer-executable instructions to increase processing power. The processing unit also can comprise a central processing unit and co-processors, and/or dedicated or special purpose processing units (e.g., an audio processor). The memory 120 may be volatile memory (e.g., registers, cache, RAM), non-volatile memory (e.g., ROM, EEPROM, flash memory), or some combination of the two. The memory 120 stores software 180 implementing one or more audio processing techniques and/or systems according to one or more of the described embodiments.

A computing environment may have additional features. For example, the computing environment 100 includes storage 140, one or more input devices 150, one or more output devices 160, and one or more communication connections 170. An interconnection mechanism (not shown) such as a bus, controller, or network interconnects the components of the computing environment 100. Typically, operating system software (not shown) provides an operating environment for software executing in the computing environment 100 and coordinates activities of the components of the computing environment 100.

The storage 140 may be removable or non-removable, and includes magnetic disks, magnetic tapes or cassettes, CDs, DVDs, or any other medium which can be used to store information and which can be accessed within the computing environment 100. The storage 140 stores instructions for the software 180.

The input device(s) 150 may be a touch input device such as a keyboard, mouse, pen, touch screen or trackball, a voice input device, a scanning device, or another device that provides input to the computing environment 100. For audio or video, the input device(s) 150 may be a microphone, sound card, video card, TV tuner card, or similar device that accepts audio or video input in analog or digital form, or a CD or DVD that reads audio or video samples into the computing environment. The output device(s) 160 may be a display, printer, speaker, CD/DVD-writer, network adapter, or another device that provides output from the computing environment 100.

The communication connection(s) 170 enable communication to one or more other computing entities. The communication connection conveys information such as computer-executable instructions, audio or video information, or other data in a data signal. A modulated data signal is a signal that has one or more of its characteristics set or changed in such a manner as to encode information in the signal. By way of example, and not limitation, communication connections include wired or wireless techniques implemented with an electrical, optical, RF, infrared, acoustic, or other carrier.

Embodiments can be described in the general context of computer-readable media. Computer-readable media are any available media that can be accessed within a computing environment. By way of example, and not limitation, with the computing environment 100, computer-readable storage media include memory 120, storage 140, and combinations of any of the above.

Embodiments can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular data types. The functionality of the program modules may be combined or split between program modules as desired in various embodiments. Computer-executable instructions for program modules may be executed within a local or distributed computing environment.

For the sake of presentation, the detailed description uses terms like "determine," "receive," and "perform" to describe computer operations in a computing environment. These terms are high-level abstractions for operations performed by a computer, and should not be confused with acts performed by a human being. The actual computer operations corresponding to these terms vary depending on implementation.

II. Example Encoders and Decoders

Figure 2:
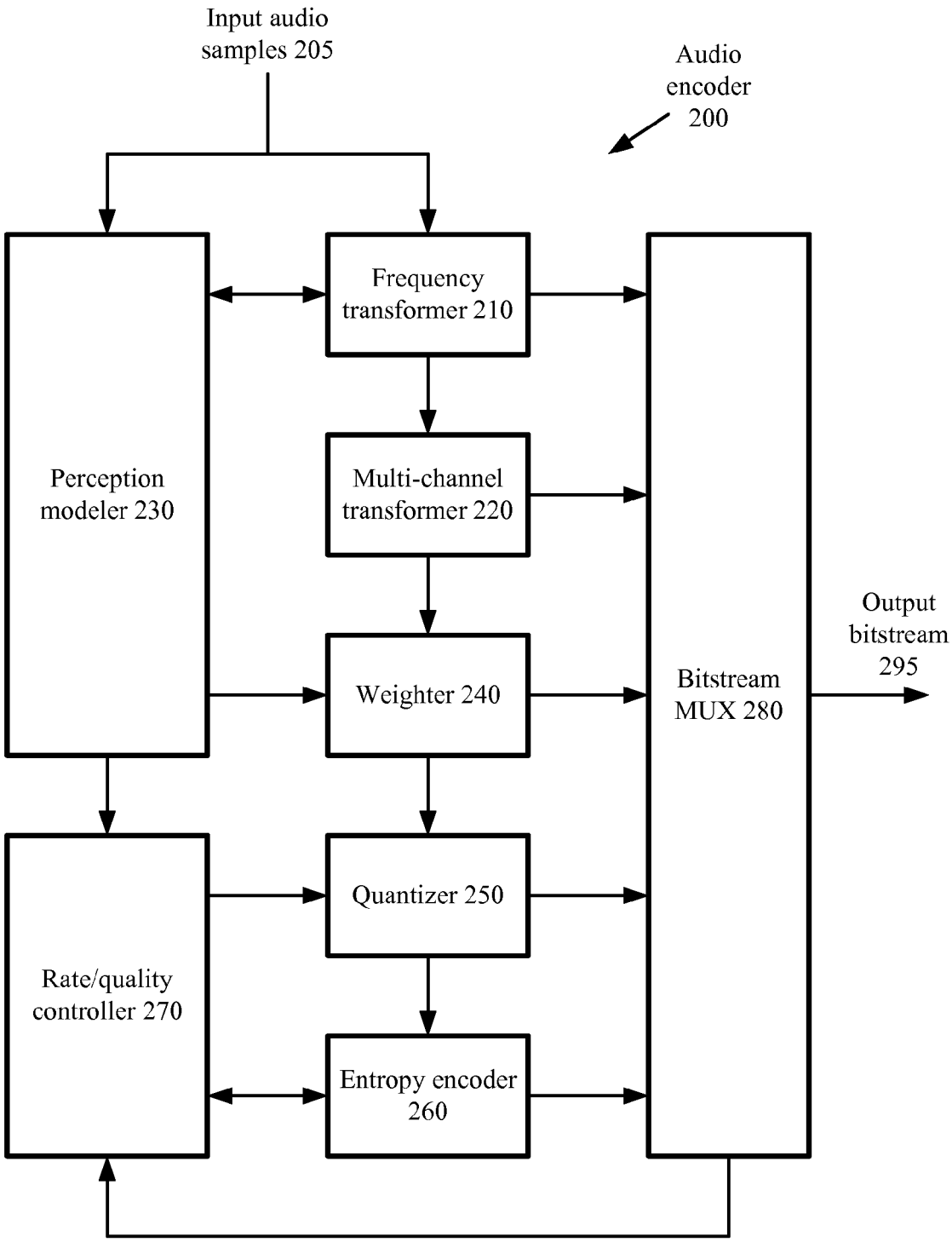
FIGS. 2, 3, 4, and 5 are block diagrams of generalized encoders and/or decoders in conjunction with which various described embodiments may be implemented.
Figure 3:
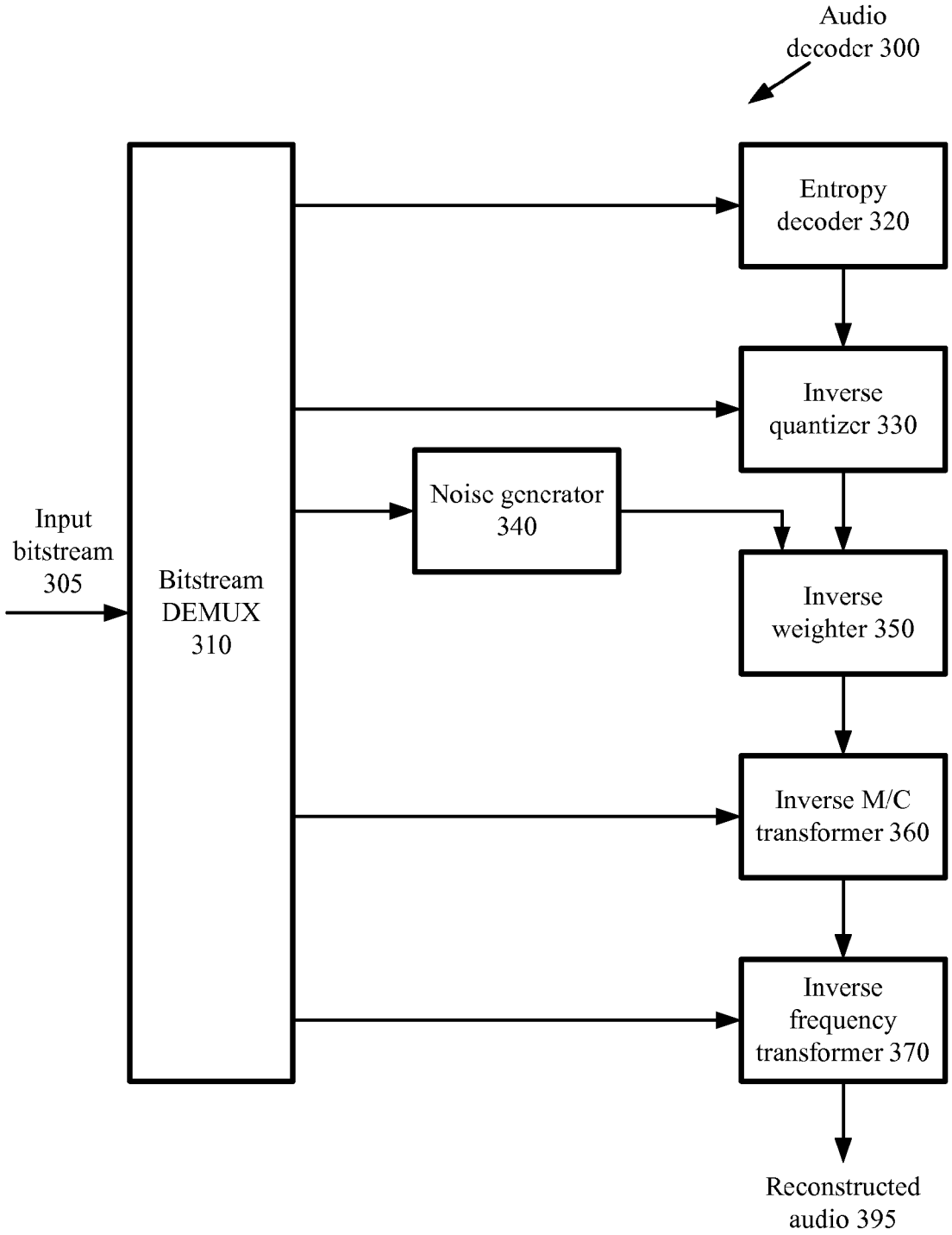

FIG. 2 shows a first audio encoder 200 in which one or more described embodiments may be implemented. The encoder 200 is a transform-based, perceptual audio encoder 200. FIG. 3 shows a corresponding audio decoder 300.

Figure 4:
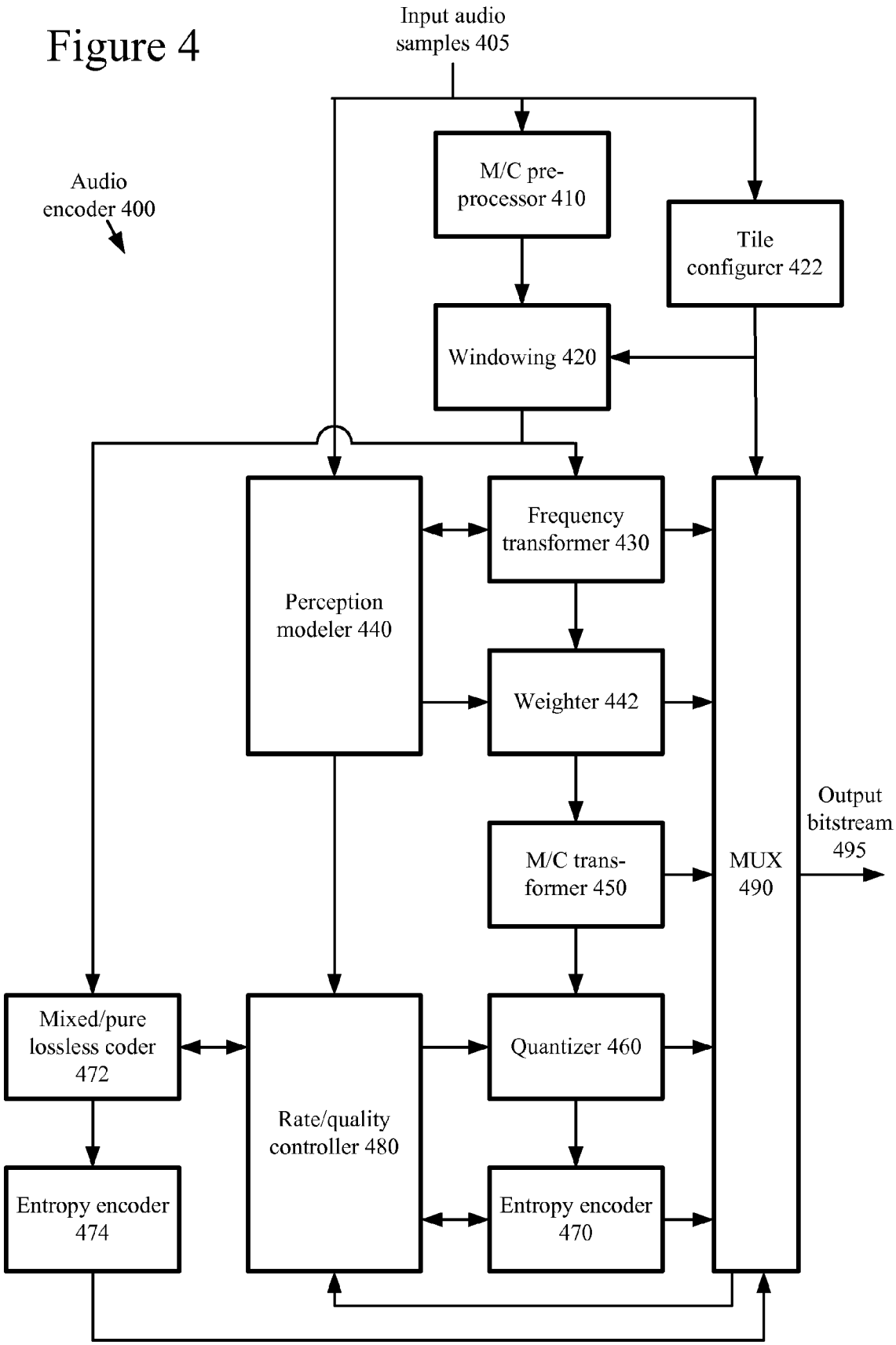
Figure 5:
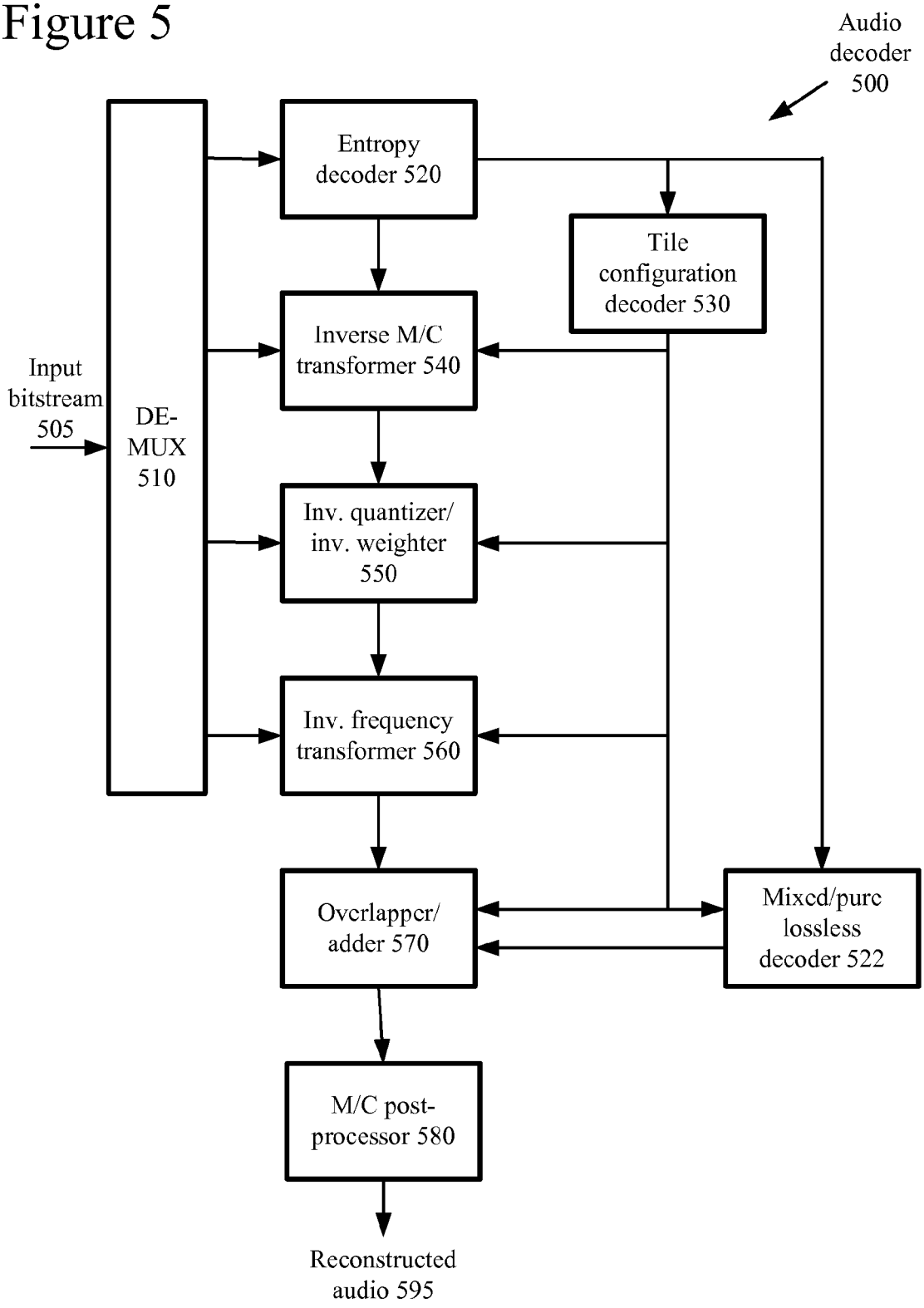

FIG. 4 shows a second audio encoder 400 in which one or more described embodiments may be implemented. The encoder 400 is again a transform-based, perceptual audio encoder, but the encoder 400 includes additional modules, such as modules for processing multi-channel audio. FIG. 5 shows a corresponding audio decoder 500.

Though the systems shown in FIGS. 2 through 5 are generalized, each has characteristics found in real world systems. In any case, the relationships shown between modules within the encoders and decoders indicate flows of information in the encoders and decoders; other relationships are not shown for the sake of simplicity. Depending on implementation and the type of compression desired, modules of an encoder or decoder can be added, omitted, split into multiple modules, combined with other modules, and/or replaced with like modules. In alternative embodiments, encoders or decoders with different modules and/or other configurations process audio data or some other type of data according to one or more described embodiments.

A. First Audio Encoder

The encoder 200 receives a time series of input audio samples 205 at some sampling depth and rate. The input audio samples 205 are for multi-channel audio (e.g., stereo) or mono audio. The encoder 200 compresses the audio samples 205 and multiplexes information produced by the various modules of the encoder 200 to output a bitstream 295 in a compression format such as a WMA format, a container format such as Advanced Streaming Format ("ASF"), or other compression or container format.

The frequency transformer 210 receives the audio samples 205 and converts them into data in the frequency (or spectral) domain. For example, the frequency transformer 210 splits the audio samples 205 of frames into sub-frame blocks, which can have variable size to allow variable temporal resolution. Blocks can overlap to reduce perceptible discontinuities between blocks that could otherwise be introduced by later quantization. The frequency transformer 210 applies to blocks a time-varying Modulated Lapped Transform ("MLT"), modulated DCT ("MDCT"), some other variety of MLT or DCT, or some other type of modulated or non-modulated, overlapped or non-overlapped frequency transform, or uses sub-band or wavelet coding. The frequency transformer 210 outputs blocks of spectral coefficient data and outputs side information such as block sizes to the multiplexer ("MUX") 280.

For multi-channel audio data, the multi-channel transformer 220 can convert the multiple original, independently coded channels into jointly coded channels. Or, the multi-channel transformer 220 can pass the left and right channels through as independently coded channels. The multi-channel transformer 220 produces side information to the MUX 280 indicating the channel mode used. The encoder 200 can apply multi-channel rematrixing to a block of audio data after a multi-channel transform.

The perception modeler 230 models properties of the human auditory system to improve the perceived quality of the reconstructed audio signal for a given bit rate. The perception modeler 230 uses any of various auditory models and passes excitation pattern information or other information to the weighter 240. For example, an auditory model typically considers the range of human hearing and critical bands (e.g., Bark bands). Aside from range and critical bands, interactions between audio signals can dramatically affect perception. In addition, an auditory model can consider a variety of other factors relating to physical or neural aspects of human perception of sound.

The perception modeler 230 outputs information that the weighter 240 uses to shape noise in the audio data to reduce the audibility of the noise. For example, using any of various techniques, the weighter 240 generates weighting factors for quantization matrices (sometimes called masks) based upon the received information. The weighting factors for a quantization matrix include a weight for each of multiple quantization bands in the matrix, where the quantization bands are frequency ranges of frequency coefficients. Thus, the weighting factors indicate proportions at which noise/quantization error is spread across the quantization bands, thereby controlling spectral/temporal distribution of the noise/quantization error, with the goal of minimizing the audibility of the noise by putting more noise in bands where it is less audible, and vice versa.

The weighter 240 then applies the weighting factors to the data received from the multi-channel transformer 220.

The quantizer 250 quantizes the output of the weighter 240, producing quantized coefficient data to the entropy encoder 260 and side information including quantization step size to the MUX 280. In FIG. 2, the quantizer 250 is an adaptive, uniform, scalar quantizer. The quantizer 250 applies the same quantization step size to each spectral coefficient, but the quantization step size itself can change from one iteration of a quantization loop to the next to affect the bit rate of the entropy encoder 260 output. Other kinds of quantization are non-uniform, vector quantization, and/or non-adaptive quantization.

The entropy encoder 260 losslessly compresses quantized coefficient data received from the quantizer 250, for example, performing run-level coding and vector variable length coding. The entropy encoder 260 can compute the number of bits spent encoding audio information and pass this information to the rate/quality controller 270.

The controller 270 works with the quantizer 250 to regulate the bit rate and/or quality of the output of the encoder 200. The controller 270 outputs the quantization step size to the quantizer 250 with the goal of satisfying bit rate and quality constraints.

In addition, the encoder 200 can apply noise substitution and/or band truncation to a block of audio data.

The MUX 280 multiplexes the side information received from the other modules of the audio encoder 200 along with the entropy encoded data received from the entropy encoder 260. The MUX 280 can include a virtual buffer that stores the bitstream 295 to be output by the encoder 200.

B. First Audio Decoder

The decoder 300 receives a bitstream 305 of compressed audio information including entropy encoded data as well as side information, from which the decoder 300 reconstructs audio samples 395.

The demultiplexer ("DEMUX") 310 parses information in the bitstream 305 and sends information to the modules of the decoder 300. The DEMUX 310 includes one or more buffers to compensate for short-term variations in bit rate due to fluctuations in complexity of the audio, network jitter, and/or other factors.

The entropy decoder 320 losslessly decompresses entropy codes received from the DEMUX 310, producing quantized spectral coefficient data. The entropy decoder 320 typically applies the inverse of the entropy encoding techniques used in the encoder.

The inverse quantizer 330 receives a quantization step size from the DEMUX 310 and receives quantized spectral coefficient data from the entropy decoder 320. The inverse quantizer 330 applies the quantization step size to the quantized frequency coefficient data to partially reconstruct the frequency coefficient data, or otherwise performs inverse quantization.

From the DEMUX 310, the noise generator 340 receives information indicating which bands in a block of data are noise substituted as well as any parameters for the form of the noise. The noise generator 340 generates the patterns for the indicated bands, and passes the information to the inverse weighter 350.

The inverse weighter 350 receives the weighting factors from the DEMUX 310, patterns for any noise-substituted bands from the noise generator 340, and the partially reconstructed frequency coefficient data from the inverse quantizer 330. As necessary, the inverse weighter 350 decompresses weighting factors. The inverse weighter 350 applies the weighting factors to the partially reconstructed frequency coefficient data for bands that have not been noise substituted. The inverse weighter 350 then adds in the noise patterns received from the noise generator 340 for the noise-substituted bands.

The inverse multi-channel transformer 360 receives the reconstructed spectral coefficient data from the inverse weighter 350 and channel mode information from the DEMUX 310. If multi-channel audio is in independently coded channels, the inverse multi-channel transformer 360 passes the channels through. If multi-channel data is in jointly coded channels, the inverse multi-channel transformer 360 converts the data into independently coded channels.

The inverse frequency transformer 370 receives the spectral coefficient data output by the multi-channel transformer 360 as well as side information such as block sizes from the DEMUX 310. The inverse frequency transformer 370 applies the inverse of the frequency transform used in the encoder and outputs blocks of reconstructed audio samples 395.

C. Second Audio Encoder

With reference to FIG. 4, the encoder 400 receives a time series of input audio samples 405 at some sampling depth and rate. The input audio samples 405 are for multi-channel audio (e.g., stereo, surround) or mono audio. The encoder 400 compresses the audio samples 405 and multiplexes information produced by the various modules of the encoder 400 to output a bitstream 495 in a compression format such as a WMA Pro format, a container format such as ASF, or other compression or container format.

The encoder 400 selects between multiple encoding modes for the audio samples 405. In FIG. 4, the encoder 400 switches between a mixed/pure lossless coding mode and a lossy coding mode. The lossless coding mode includes the mixed/pure lossless coder 472 and is typically used for high quality (and high bit rate) compression. The lossy coding mode includes components such as the weighter 442 and quantizer 460 and is typically used for adjustable quality (and controlled bit rate) compression. The selection decision depends upon user input or other criteria.

For lossy coding of multi-channel audio data, the multi-channel pre-processor 410 optionally re-matrixes the time-domain audio samples 405. For example, the multi-channel pre-processor 410 selectively re-matrixes the audio samples 405 to drop one or more coded channels or increase inter-channel correlation in the encoder 400, yet allow reconstruction (in some form) in the decoder 500. The multi-channel pre-processor 410 may send side information such as instructions for multi-channel post-processing to the MUX 490.

The windowing module 420 partitions a frame of audio input samples 405 into sub-frame blocks (windows). The windows may have time-varying size and window shaping functions. When the encoder 400 uses lossy coding, variable-size windows allow variable temporal resolution. The windowing module 420 outputs blocks of partitioned data and outputs side information such as block sizes to the MUX 490.

In FIG. 4, the tile configurer 422 partitions frames of multi-channel audio on a per-channel basis. The tile configurer 422 independently partitions each channel in the frame, if quality/bit rate allows. This allows, for example, the tile configurer 422 to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the tile configurer 422 groups windows of the same size that are co-located in time as a tile.

The frequency transformer 430 receives audio samples and converts them into data in the frequency domain, applying a transform such as described above for the frequency transformer 210 of FIG. 2. The frequency transformer 430 outputs blocks of spectral coefficient data to the weighter 442 and outputs side information such as block sizes to the MUX 490. The frequency transformer 430 outputs both the frequency coefficients and the side information to the perception modeler 440.

The perception modeler 440 models properties of the human auditory system, processing audio data according to an auditory model, generally as described above with reference to the perception modeler 230 of FIG. 2.

The weighter 442 generates weighting factors for quantization matrices based upon the information received from the perception modeler 440, generally as described above with reference to the weighter 240 of FIG. 2. The weighter 442 applies the weighting factors to the data received from the frequency transformer 430. The weighter 442 outputs side information such as the quantization matrices and channel weight factors to the MUX 490. The quantization matrices can be compressed.

For multi-channel audio data, the multi-channel transformer 450 may apply a multi-channel transform to take advantage of inter-channel correlation. For example, the multi-channel transformer 450 selectively and flexibly applies the multi-channel transform to some but not all of the channels and/or quantization bands in the tile. The multi-channel transformer 450 selectively uses pre-defined matrices or custom matrices, and applies efficient compression to the custom matrices. The multi-channel transformer 450 produces side information to the MUX 490 indicating, for example, the multi-channel transforms used and multi-channel transformed parts of tiles.

The quantizer 460 quantizes the output of the multi-channel transformer 450, producing quantized coefficient data to the entropy encoder 470 and side information including quantization step sizes to the MUX 490. In FIG. 4, the quantizer 460 is an adaptive, uniform, scalar quantizer that computes a quantization factor per tile, but the quantizer 460 may instead perform some other kind of quantization.

The entropy encoder 470 losslessly compresses quantized coefficient data received from the quantizer 460, generally as described above with reference to the entropy encoder 260 of FIG. 2.

The controller 480 works with the quantizer 460 to regulate the bit rate and/or quality of the output of the encoder 400. The controller 480 outputs the quantization factors to the quantizer 460 with the goal of satisfying quality and/or bit rate constraints.

The mixed/pure lossless encoder 472 and associated entropy encoder 474 compress audio data for the mixed/pure lossless coding mode. The encoder 400 uses the mixed/pure lossless coding mode for an entire sequence or switches between coding modes on a frame-by-frame, block-by-block, tile-by-tile, or other basis.

The MUX 490 multiplexes the side information received from the other modules of the audio encoder 400 along with the entropy encoded data received from the entropy encoders 470, 474. The MUX 490 includes one or more buffers for rate control or other purposes.

D. Second Audio Decoder

With reference to FIG. 5, the second audio decoder 500 receives a bitstream 505 of compressed audio information. The bitstream 505 includes entropy encoded data as well as side information from which the decoder 500 reconstructs audio samples 595.

The DEMUX 510 parses information in the bitstream 505 and sends information to the modules of the decoder 500. The DEMUX 510 includes one or more buffers to compensate for short-term variations in bit rate due to fluctuations in complexity of the audio, network jitter, and/or other factors.

The entropy decoder 520 losslessly decompresses entropy codes received from the DEMUX 510, typically applying the inverse of the entropy encoding techniques used in the encoder 400. When decoding data compressed in lossy coding mode, the entropy decoder 520 produces quantized spectral coefficient data.

The mixed/pure lossless decoder 522 and associated entropy decoder(s) 520 decompress losslessly encoded audio data for the mixed/pure lossless coding mode.

The tile configuration decoder 530 receives and, if necessary, decodes information indicating the patterns of tiles for frames from the DEMUX 590. The tile pattern information may be entropy encoded or otherwise parameterized. The tile configuration decoder 530 then passes tile pattern information to various other modules of the decoder 500.

The inverse multi-channel transformer 540 receives the quantized spectral coefficient data from the entropy decoder 520 as well as tile pattern information from the tile configuration decoder 530 and side information from the DEMUX 510 indicating, for example, the multi-channel transform used and transformed parts of tiles. Using this information, the inverse multi-channel transformer 540 decompresses the transform matrix as necessary, and selectively and flexibly applies one or more inverse multi-channel transforms to the audio data.

The inverse quantizer/weighter 550 receives information such as tile and channel quantization factors as well as quantization matrices from the DEMUX 510 and receives quantized spectral coefficient data from the inverse multi-channel transformer 540. The inverse quantizer/weighter 550 decompresses the received weighting factor information as necessary. The quantizer/weighter 550 then performs the inverse quantization and weighting.

The inverse frequency transformer 560 receives the spectral coefficient data output by the inverse quantizer/weighter 550 as well as side information from the DEMUX 510 and tile pattern information from the tile configuration decoder 530. The inverse frequency transformer 570 applies the inverse of the frequency transform used in the encoder and outputs blocks to the overlapper/adder 570.

In addition to receiving tile pattern information from the tile configuration decoder 530, the overlapper/adder 570 receives decoded information from the inverse frequency transformer 560 and/or mixed/pure lossless decoder 522. The overlapper/adder 570 overlaps and adds audio data as necessary and interleaves frames or other sequences of audio data encoded with different modes.

The multi-channel post-processor 580 optionally re-matrixes the time-domain audio samples output by the overlapper/adder 570. For bitstream-controlled post-processing, the post-processing transform matrices vary over time and are signaled or included in the bitstream 505.

III. Encoder/Decoder With Sparse Spectral Peak Coding

Figure 6:
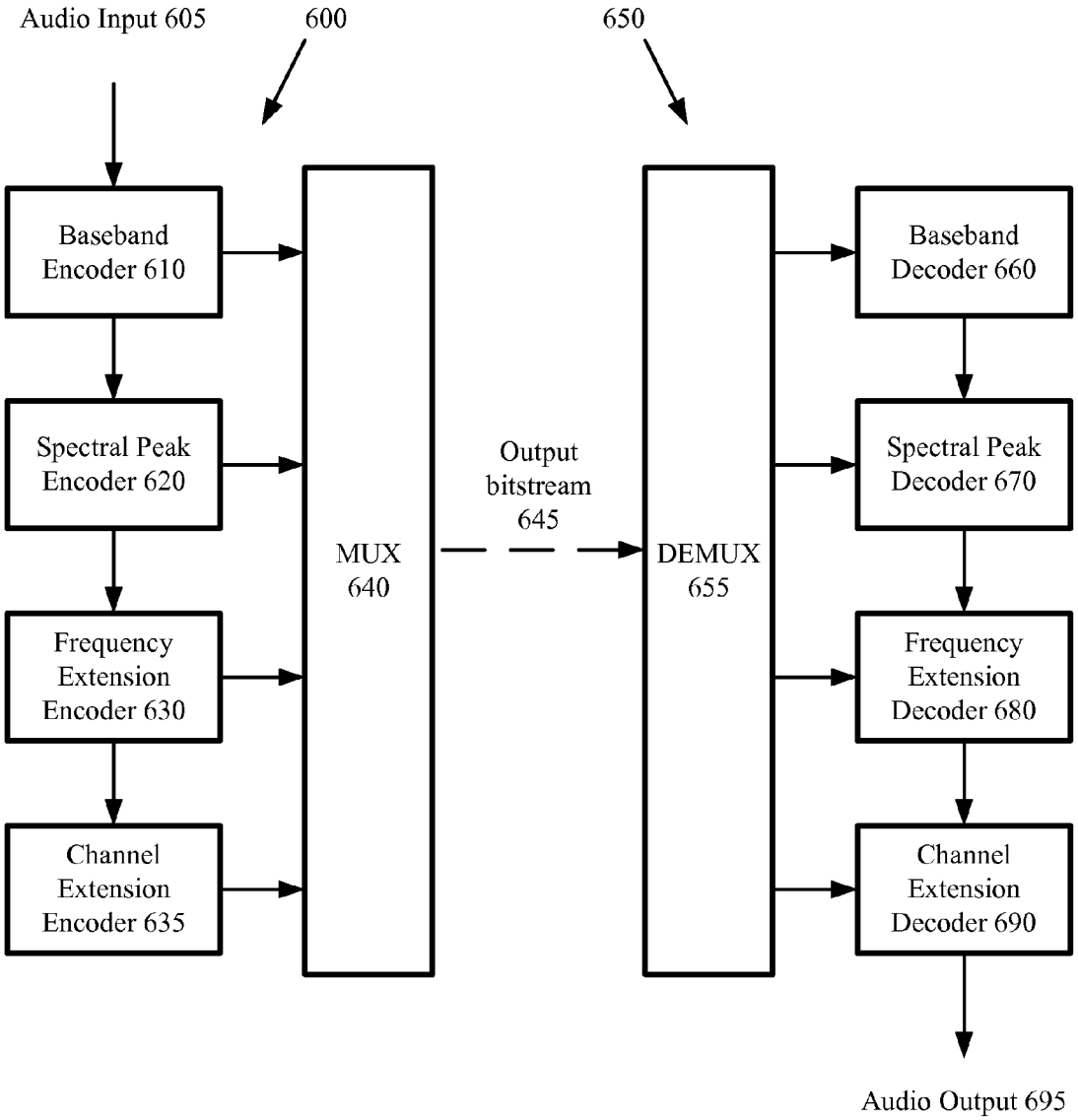
FIG. 6 is a data flow diagram of an audio encoding and decoding method that includes sparse spectral peak encoding and decoding.

FIG. 6 illustrates an extension of the above described transform-based, perceptual audio encoders/decoders of FIGS. 2-5 that further provides efficient encoding of sparse spectral peak data. As discussed in the Background above, the application of transform-based, perceptual audio encoding at low bit rates can produce transform coefficient data for encoding that may contain a sparse number of spectral peaks that represent high frequency tonal components (such as may correspond to high pitched string and other musical instruments) separated by very long runs of zero-value coefficients. Previous approaches using run-length Huffman coding techniques were inefficient because the sparse spectral peaks incurred costly escape coding.

In the illustrated extension 600, an audio encoder 600 processes audio received at an audio input 605, and encodes a representation of the audio as an output bitstream 645. An audio decoder 650 receives and processes this output bitstream to provide a reconstructed version of the audio at an audio output 695. In the audio encoder 600, portions of the encoding process are divided among a baseband encoder 610, a spectral peak encoder 620, a frequency extension encoder 630 and a channel extension encoder 635. A multiplexor 640 organizes the encoding data produced by the baseband encoder, spectral peak encoder, frequency extension encoder and channel extension coder into the output bitstream 645.

On the encoding end, the baseband encoder 610 first encodes a baseband portion of the audio. This baseband portion is a preset or variable "base" portion of the audio spectrum, such as a baseband up to an upper bound frequency of 4 KHz. The baseband alternatively can extend to a lower or higher upper bound frequency. The baseband encoder 610 can be implemented as the above-described encoders 200, 400 (FIGS. 2, 4) to use transform-based, perceptual audio encoding techniques to encode the baseband of the audio input 605.

The spectral peak encoder 620 encodes the transform coefficients above the upper bound of the baseband using an efficient spectral peak encoding described further below. This spectral peak encoding uses a combination of intra-frame and inter-frame spectral peak encoding modes. The intra-frame spectral peak encoding mode encodes transform coefficients corresponding to a spectral peak as a value trio of a zero run, and the two transform coefficients following the zero run (e.g., (R,($L_0$,$L_1$)) ). This value trio is separately entropy coded or jointly entropy coded. The inter-frame spectral peak encoding mode uses predictive encoding of a position of the spectral peak relative to its position in a preceding frame. The shift amount (S) from the predictive position is encoded with two transform coefficient levels (e.g., (S,($L_0$,$L_1$)). This value trio is separately entropy coded or jointly entropy coded.

The frequency extension encoder 630 is another technique used in the encoder 600 to encode the higher frequency portion of the spectrum. This technique (herein called "frequency extension") takes portions of the already coded spectrum or vectors from a fixed codebook, potentially applying a non-linear transform (such as, exponentiation or combination of two vectors) and scaling the frequency vector to represent a higher frequency portion of the audio input. The technique can be applied in the same transform domain as the baseband encoding, and can be alternatively or additionally applied in a transform domain with a different size (e.g., smaller) time window.

The channel extension encoder 635 implements techniques for encoding multi-channel audio. This "channel extension" technique takes a single channel of the audio and applies a bandwise scale factor. In one implementation, the bandwise scale factor is applied in a complex transform domain having a smaller time window than that of the transform used by the baseband encoder. Alternatively, the transform domain for channel extension can be the same or different that that used for baseband encoding, and need not be complex (i.e., can be a real-value domain). The channel extension encoder derives the scale factors from parameters that specify the normalized correlation matrix for channel groups. This allows the channel extension decoder 680 to reconstruct additional channels of the audio from a single encoded channel, such that a set of complex second order statistics (i.e., the channel correlation matrix) is matched to the encoded channel on a bandwise basis.

On the side of the audio decoder 650, a demultiplexor 655 again separates the encoded baseband, spectral peak, frequency extension and channel extension data from the output bitstream 645 for decoding by a baseband decoder 660, a spectral peak decoder 670, a frequency extension decoder 680 and a channel extension decoder 690. Based on the information sent from their counterpart encoders, the baseband decoder, spectral peak decoder, frequency extension decoder and channel extension decoder perform an inverse of the respective encoding processes, and together reconstruct the audio for output at the audio output 695.

A. Sparse Spectral Peak Encoding Procedure

Figure 7:
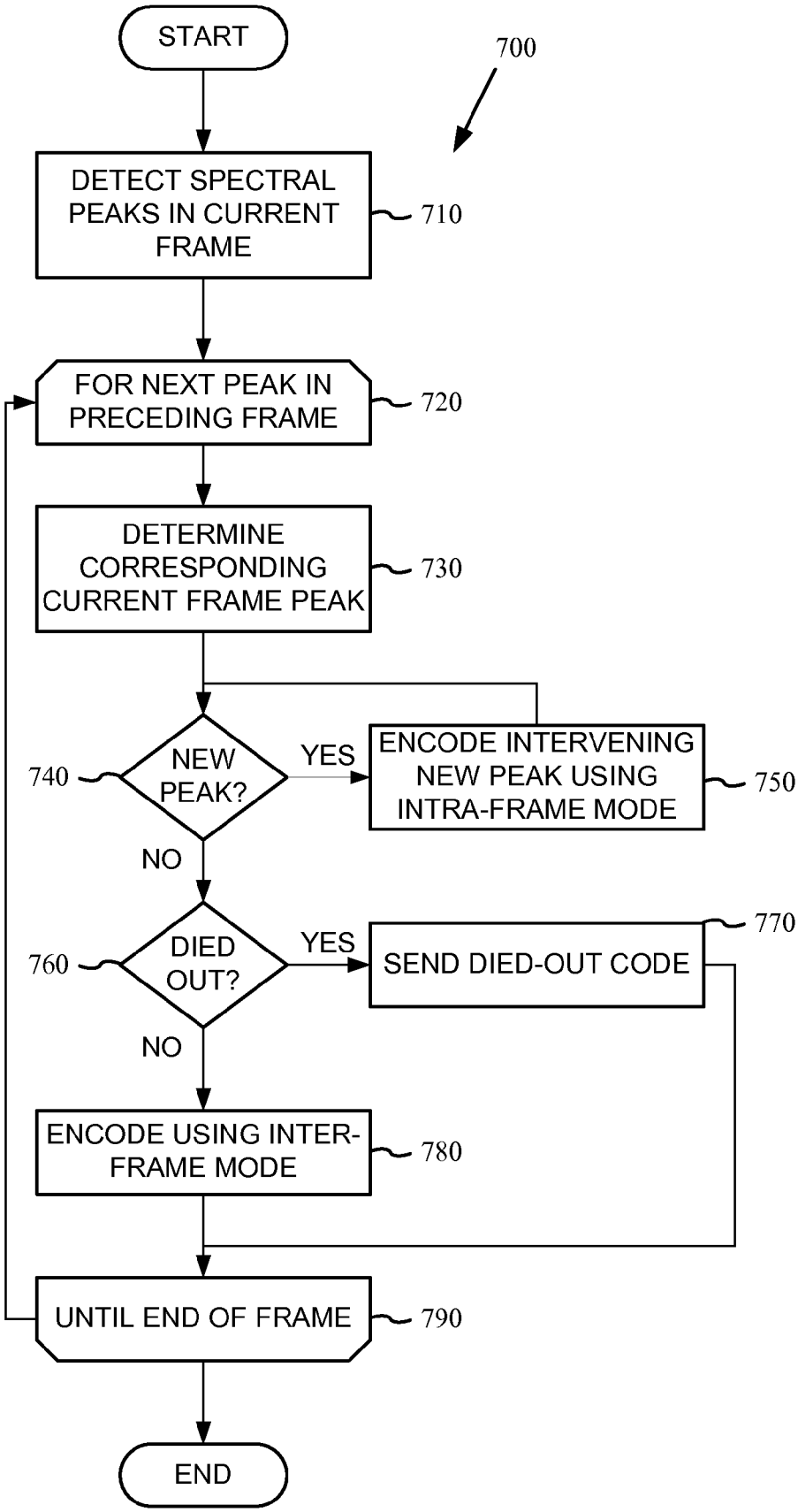
FIG. 7 is a flow diagram of a process for sparse spectral peak encoding.

FIG. 7 illustrates a procedure implemented by the spectral peak encoder 620 for encoding sparse spectral peak data. The encoder 600 invokes this procedure to encode the transform coefficients above the baseband's upper bound frequency (e.g., over 4 KHz) when this high frequency portion of the spectrum is determined to (or is likely to) contain sparse spectral peaks. This is most likely to occur after quantization of the transform coefficients for low bit rate encoding.

The spectral peak encoding procedure encodes the spectral peaks in this upper frequency band using two separate coding modes, which are referred to herein as intra-frame mode and inter-frame mode. In the intra-frame mode, the spectral peaks are coded without reference to data from previously coded frames. The transform coefficients of the spectral peak are coded as a value trio of a zero run (R), and two transform coefficient levels ($L_0$,$L_1$). The zero run (R) is a length of a run of zero-value coefficients from a last coded transform coefficient. The transform coefficient levels are the quantized values of the next two non-zero transform coefficients. The quantization of the spectral peak coefficients may be modified from the base step size (e.g., via a mask modifier), as is shown in the syntax tables below). Alternatively, the quantization applied to the spectral peak coefficients can use a different quantizer separate from that applied to the base band coding (e.g., a different step size or even different quantization scheme, such as non-linear quantization). The value trio (R, ($L_0$,$L_1$)) is then entropy coded separately or jointly, such as via a Huffman coding.

The inter-frame mode uses predictive coding based on the position of spectral peaks in a previous frame of the audio. In the illustrated procedure, the position is predicted based on spectral peaks in an immediately preceding frame. However, alternative implementations of the procedure can apply predictions based on other or additional frames of the audio, including bi-directional prediction. In this inter-frame mode, the transform coefficients are encoded as a shift (S) or offset of the current frame spectral peak from its predicted position. For the illustrated implementation, the predicted position is that of the corresponding previous frame spectral peak. However, the predicted position in alternative implementations can be a linear or other combination of the previous frame spectral peak and other frame information. The position S and two transform coefficient levels ($L_0$,$L_1$) are entropy coded separately or jointly with Huffman coding techniques. In the inter-frame mode, there are cases where some of the predicted position are unused by spectral peaks of the current frame. In one implementation to signal such "died-out" positions, the "died-out" code is embedded into the Huffman table of the shift (S).

In alternative implementations, the intra-frame coded value trio (R,($L_0$,$L_1$)) and/or the inter-mode trio (S,($L_0$,$L_1$)) could be coded by further predicting from previous trios in the current frame or previous frame when such coding further improves coding efficiency.

Each spectral peak in a frame is classified into intra-frame mode or inter-frame mode. One criteria of the classification can be to compare bit counts of coding the spectral peak with each mode, and choose the mode yielding the lower bit count. As a result, frames with spectral peaks can be intra-frame mode only, inter-frame mode only, or a combination of intra-frame and inter-frame mode coding.

First (action 710), the spectral peak encoder 620 detects spectral peaks in the transform coefficient data for a frame (the "current frame") of the audio input that is currently being encoded. These spectral peaks typically correspond to high frequency tonal components of the audio input, such as may be produced by high pitched string instruments. In the transform coefficient data, the spectral peaks are the transform coefficients whose levels form local maximums, and typically are separated by very long runs of zero-level transform coefficients (for sparse spectral peak data).

In a next loop of actions 720-790, the spectral peak encoder 620 then compares the positions of the current frame's spectral peaks to those of the predictive frame (e.g., the immediately preceding frame in the illustrated implementation of the procedure). In the special case of the first frame (or other seekable frames) of the audio, there is no preceding frame to use for inter-frame mode predictive coding. In which case, all spectral peaks are determined to be new peaks that are encoded using the intra-frame coding mode, as indicated at actions 740, 750.

Within the loop 720-790, the spectral peak encoder 620 traverses a list of spectral peaks that were detected during processing an immediately preceding frame of the audio input. For each previous frame spectral peak, the spectral peak encoder 620 searches among the spectral peaks of the current frame to determine whether there is a corresponding spectral peak in the current frame (action 730). For example, the spectral peak encoder 620 can determine that a current frame spectral peak corresponds to a previous frame spectral peak if the current frame spectral peak is closest to the previous frame spectral peak, and is also closer to that previous frame spectral peak than any other spectral peak of the current frame.

If the spectral peak encoder 620 encounters any intervening new spectral peaks before the corresponding current frame spectral peak (decision 740), the spectral peak encoder 620 encodes (action 750) the new spectral peak(s) using the intra-frame mode as a sequence of entropy coded value trios, $(R,(L_0,L_1))$.

If the spectral peak encoder 620 determines there is no corresponding current frame spectral peak for the previous frame spectral peak (i.e., the spectral peak has "died out," as indicated at decision 740), the spectral peak encoder 620 sends a code indicating the spectral peak has died out (action 750). For example, the spectral peak encoder 620 can determine there is no corresponding current frame spectral peak when a next current frame spectral peak is closer to the next previous frame spectral peak.

Otherwise, the spectral peak encoder 620 encodes the position of the current frame spectral peak using the inter-frame mode (action 780), as described above. If the shape of the current frame spectral peak has changed, the spectral peak encoder 620 further encodes the shape of the current frame spectral peak using the intra-frame mode coding (i.e., combined inter-frame/intra-frame mode), as also described above.

The spectral peak encoder 620 continues the loop 720-790 until all spectral peaks in the high frequency band are encoded.

B. Sparse Spectral Peak Coding Syntax

The following coding syntax table illustrates one possible coding syntax for the sparse spectral peak coding in the illustrated encoder 600/decoder 650 (FIG. 6). This coding syntax can be varied for other alternative implementations of the sparse spectral peak coding technique, such as by assigning different code lengths and values to represent coding mode, shift (S), zero run (R), and two levels $(L_0,L_1)$. In the following syntax tables, the presence of spectral peak data is signaled by a one bit flag ("bBasePeakPresentTile"). The data of each spectral peak is signaled to be one of four types:

1. "BasePeakCoefNo" signals no spectral peak data;
2. "BasePeakCoefInd" signals intra-frame coded spectral peak data;
3. "BasePeakCoefInterPred" signals inter-frame coded spectral peak data; and
4. "BasePeakCoefInterPredAndInd" signals combined intra-frame and inter-frame coded spectral peak data.

When inter-frame spectral peak coding mode is used, the spectral peak is coded as a shift ("iShift") from its predicted position and two transform coefficient levels (represented as "iLevel," "iShape," and "iSign" in the syntax table) in the frame. When intra-frame spectral peak coding mode is used, the transform coefficients of the spectral peak are signaled as zero run ("cRun") and two transform coefficient levels ("iLevel," "iShape," and "iSign").

The following variables are used in the sparse spectral peak coding syntax shown in the following tables:

iMaskDiff/iMaskEscape: parameter used to modify mask values to adjust quantization step size from base step size.

iBasePeakCoefPred: indicates mode used to code spectral peaks (no peaks, intra peaks only, inter peaks only, intra & inter peaks).

BasePeakNLQDecTbl: parameter used for nonlinear quantization.

iShift: S parameter in (S,(L0,L1)) trio for peaks which are coded using inter-frame prediction (specifies shift or specifies if peaks from previous frame have died out).

cBasePeaksIndCoeffs: number of intra coded peaks.

bEnableShortZeroRun/bConstrainedZeroRun: parameter to control how the R parameter is coded in intra-mode peaks.

cRun: R parameter in the R,(L0,L1) value trio for intra-mode peaks.

iLevel/iShape/iSign: coding (L0,L1) portion of trio.

iBasePeakShapeCB: codebook used to control shape of (L0,L1)

TABLE 1

| Syntax | # bits | Notes |
|---|---|---|
| plusDecodeBasePeak( ) | | |
| { | | |
| if (any bits left?) | | |
| bBasePeakPresentTile | 1 | fixed length |
| } | | |

TABLE 2

| Syntax | # bits | Notes |
|---|---|---|
| plusDecodeBasePeak_Channel( ) | | |
| { | | |
| iMaskDiff | 2-7 | variable length |
| if (iMaskDiff==g_bpeakMaxMaskDelta-g_bpeakMinMaskDelta+2 \|\| | | |
| iMaskDiff==g_bpeakMaxMaskDelta-g_bpeakMinMaskDelta+1) | | |
| iMaskEscape | 3 | fixed length |
| if (ChannelPower==0) | | |
| exit | | |
| iBasePeakCoefPred | 2 | fixed length |
| /* 00: BasePeakCoefNo, | | |
| 01: BasePeakCoefInd | | |
| 10: BasePeakCoefInterPred, | | |
| 11: BasePeakCoefInterPredAndInd */ | | |
| if (iBasePeakCoefPred==BasePeakCoefNo) | | |
| exit | | |

TABLE 2-continued

| Syntax | # bits | Notes |
|---|---|---|
| if (bBasePeakFirstTile) | | |
| BasePeakNLQDecTbl | 2 | fixed length |
| iBasePeakShapeCB | 1-2 | variable length |
| /* 0: CB=0, 10: CB=1, 11: CB=2 */ | | |
| if (iBasePeakCoefPred==BasePeakCoefInterPred \|\| iBasePeakCoefPred==BasePeakCoefInterPredAndInd) | | |
| { | | |
| for (i=0; i<cBasePeakCoefs; i++) | | |
| iShift /* −5, −4, . . . 0, . . . 4, 5, and remove */ | 1-9 | variable length |
| } | | |
| Update cBasePeakCoefs | | |
| if (iBasePeakCoefPred==BasePeakCoefInd \|\| iBasePeakCoefPred==BasePeakCoefInterPredAndInd) | | |
| { | | |
| cBasePeaksIndCoefs | 3-8 | variable length |
| bEnableShortZeroRun | 1 | fixed length |
| bConstrainedZeroRun | 1 | fixed length |
| cMaxBitsRun=LOG2(SubFramesize >> 3) | | |
| iOffsetRun=0 | | |
| if (bEnableShortZeroRun) | | |
| iOffsetRun=3 | | |
| iLastCodedIndex = iBasePeakLastCodedIndex; | | |
| for (i=0; i<cBasePeakIndCoefs; i++) | | |
| { | | |
| cBitsRun=CEILLOG2(SubFrameSize−iLastCodedIndex −1−iOffsetRun) | | |
| if (bConstrainedZeroRun) | | |
| cBitsRun=max(cBitsRun,cMaxBitsRun) | | |
| if (bEnableShortZeroRun) | | |
| cRun | 2-cBitsRun | variable length |
| Else | | |
| cRun | cBitsRun | variable length |
| iLastCodedIndex+=cRun+1 | | |
| cBasePeakCoefs++ | | |
| } | | |
| } | | |
| for (i=0; i<cBasePeakCoefs; i++) | | |
| { | | |
| iLevel | 1-8 | variable length |
| switch (iBasePeakShapeCB) | | |
| { | | |
| case 0: iShape=0 | | S |
| case 1: iShape | 1-3 | variable length |
| case 2: iShape | 2-4 | variable length |
| } | | |
| iSign | 1 | fixed length |
| } | | |
| } | | |

In view of the many possible embodiments to which the principles of our invention may be applied, we claim as our invention all such embodiments as may come within the scope and spirit of the following claims and equivalents thereto.

We claim:

1. A method of compressively encoding audio signal data containing a time series of audio signal samples as a compressed data stream, the method comprising:

transforming successive blocks of the audio signal data into sets of spectral coefficients;

quantizing the spectral coefficients;

for at least a portion of the spectral coefficients in the sets, detecting any spectral peaks out of the spectral coefficients in the portion;

correlating spectral peaks detected out of the set of spectral coefficients for a current block to spectral peaks detected out of the spectral coefficients for a preceding block of the audio signal data; and encoding information to represent those of the spectral peaks for the current block that correlate to spectral peaks for the preceding block in the compressed data stream using temporal prediction coding and encoding information to represent at least some of the spectral peaks in the compressed data stream using at least one three value combination of a length of a run of zero-valued spectral coefficients and levels of two spectral coefficients following the run.

2. The method of claim 1 wherein said encoding using a three value combination comprises encoding the information using a joint or separate entropy code that represents the three value combination.

3. The method of claim 1 wherein said encoding using temporal prediction coding comprises using a code that represents a shift in position of a current block spectral peak from that of a preceding block spectral block to which the current block spectral peak correlates.

4. The method of claim 1 wherein said encoding using temporal prediction coding comprises using a code that represents a combination of a shift in position of a current block spectral peak from that of a preceding block spectral peak to which the current block spectral peak correlates, and two peak coefficient levels.

5. A method of decoding the compressed data stream encoded according to the method of claim 4, the method of decoding comprising:

reading information representing spectral peaks from the compressed data stream;

for the spectral peak information encoded using at least one three value combination, decoding the three value combination code to determine spectral coefficients for the spectral peak from the values of zero-run length and levels;

for the spectral peak information encoded using temporal prediction coding, decoding the combination code to determine spectral coefficients for the spectral peak from the value of the shift and the peak coefficient levels;

de-quantizing the spectral coefficients; and inverse transforming the spectral coefficients to reconstruct the time series of audio signal samples.

6. An audio data processor, comprising:

an input for receiving an audio data stream containing a time series of audio signal samples;

a time-frequency transform for transforming successive blocks of the audio signal samples to produce sets of spectral coefficients;

a spectral peak encoder operating to detect spectral peaks in at least a portion of the spectral coefficient sets, and operating to encode individual ones of the detected spectral peaks using one of a temporal prediction coding and a zero run coding, wherein the spectral peak encoder operates to correlate the detected spectral peaks in the portion of successive spectral coefficient sets to those in the portion of their preceding spectral coefficient sets, and to encode the detected spectral peaks that correlate to spectral peaks in preceding spectral coefficient sets using the temporal prediction coding and otherwise to encode the detected spectral peaks using the zero run coding.

7. The audio data processor of claim 6 wherein the temporal prediction coding encodes a detected spectral peak as a position shift from a correlated spectral peak in the preceding spectral coefficient set.

8. The audio data processor of claim 6, wherein the zero run coding encodes a detected spectral peak as at least one multi-value combination comprising a length of a run of zero-valued spectral coefficients preceding the detected spectral peak, and levels of a pair of spectral coefficients following the run.

9. The audio data processor of claim 8, wherein the zero run coding further comprises a joint entropy encoding of the at least one multi-value combination.

10. The audio data processor of claim 8, wherein the temporal prediction coding further operates to encode a code indicating absence among the detected spectral peaks of a spectral peak correlating to a spectral peak in a preceding spectral coefficient set.

11. A computer-readable data storage device having instructions carried thereon, the instructions being executable by an audio data processor to perform a method of compressing an audio data stream, the method comprising:

transforming successive blocks of a time sample audio data stream into sets of spectral coefficients;

quantizing the spectral coefficients;

encoding the spectral coefficients into a compressed audio data stream, wherein said encoding for at least a portion of the spectral coefficients of a set comprises:

identifying spectral peaks among the spectral coefficients of the portion;

correlating the identified spectral peaks of the set to spectral peak of a preceding set;

encoding those of the identified spectral peaks of the set that correlate to spectral peaks of the preceding set using a temporal prediction coding; and encoding those of the identified spectral peaks of the set that lack correlation to spectral peaks of the preceding set using a zero run length coding.

12. The computer-readable data storage device of claim 11 wherein encoding using the temporal prediction coding comprises:

encoding one of the identified spectral peaks that correlates to a spectral peak of the preceding set using a coded value representing a shift in position from the correlated spectral peak of the preceding set.

13. The computer-readable data storage device of claim 12 wherein encoding using the temporal prediction coding further comprises:

in a case that no identified spectral peak correlates to a spectral peak of the preceding set, encoding a value indicative of a died out spectral peak for a location of the spectral peak of the preceding set.

14. The computer-readable data storage device of claim 11 wherein encoding using the zero run length coding comprises:

encoding one of the identified spectral peaks that lacks correlation to the spectral peaks of the preceding set using a coded value combination of a run length of zero-level spectral coefficients and levels of two spectral coefficients.

15. The computer-readable data storage device of claim 14 wherein encoding using the zero run length coding comprises:

encoding said one of the identified spectral peaks as a joint or separate entropy code representing the coded value combination.

16. The audio data processor of claim 6, further comprising a decoder configured to read information representing spectral peaks from the compressed data stream, and for the spectral peak information encoded using at least one three value combination, decoding the three value combination code to determine spectral coefficients for the spectral peak from the values of zero-run length and levels, and for the spectral peak information encoded using temporal prediction coding, decoding the combination code to determine spectral coefficients for the spectral peak from the value of the shift and the peak coefficient levels, de-quantizing the spectral coefficients; and inverse transforming the spectral coefficients to reconstruct the time series of audio signal samples.

17. A method of decoding, comprising:

receiving a compressed audio data stream produced by the method including:

transforming successive blocks of the audio signal data into sets of spectral coefficients;

quantizing the spectral coefficients;

for at least a portion of the spectral coefficients in the sets, detecting any spectral peaks out of the spectral coefficients in the portion;

correlating spectral peaks detected out of the set of spectral coefficients for a current block to spectral peaks detected out of the spectral coefficients for a preceding block of the audio signal data; and encoding information to represent those of the spectral peaks for the current block that correlate to spectral peaks for the preceding block in the compressed data stream using temporal prediction coding and encoding information to represent at least some of the spectral peaks in the compressed data stream using at least one three value combination of a length of a run of zero-valued spectral coefficients and levels of two spectral coefficients following the run;

reading information representing spectral peaks from the compressed data stream;

for the spectral peak information encoded using at least one three value combination, decoding the three value combination code to determine spectral coefficients for the spectral peak from the values of zero-run length and levels;

for the spectral peak information encoded using temporal prediction coding, decoding the combination code to determine spectral coefficients for the spectral peak from the value of the shift and the peak coefficient levels;

de-quantizing the spectral coefficients; and inverse transforming the spectral coefficients to reconstruct the time series of audio signal samples.

* * * * *